US005275082A

United States Patent [19]

Kestner-Clifton et al.

[11] Patent Number: 5,275,082

[45] Date of Patent: Jan. 4, 1994

[54] VISUAL MUSIC CONDUCTING DEVICE

[76] Inventors: John N. Kestner-Clifton, 175 W. 87th St., Apt. 27E, New York, N.Y. 10024; Phillip M. Vogel, 318 Marlboro Rd., Englewood, N.J. 07631

[21] Appl. No.: 757,065

[22] Filed: Sep. 9, 1991

[51] Int. Cl.[5] ..... G10G 7/00

[52] U.S. Cl. ..... 84/477 B; 84/464 R

[58] Field of Search ..... 84/464

[56] References Cited

U.S. PATENT DOCUMENTS

| | | | |
|---|---|---|---|
| 3,818,693 | 6/1974 | Allard | 84/484 X |
| 4,090,355 | 5/1987 | Morohoshi | 84/484 X |
| 4,321,853 | 3/1982 | Tumblin | 84/484 X |
| 4,649,794 | 3/1987 | George | 84/484 |
| 4,982,642 | 1/1991 | Nishikawa et al. | 84/484 |

*Primary Examiner*—William M. Shoop, Jr.
*Assistant Examiner*—Jeffrey W. Donels
*Attorney, Agent, or Firm*—Richard David Goldstein

[57] ABSTRACT

An electronic visual music conducting device is provided which is adapted to receive electronic timing signals representative of the tempo of a piece of music, and to use these timing signals to control a visual display which indicates tempo and rhythm by simulating the movement of a conductor's baton, including the acceleration normally present as the baton approaches the point of a beat, and the deceleration normally present as the baton moves away from the point of a beat. The electronic timing signals are preferably MIDI System Exclusive Real Time Message Timing Clock signals (F8H). The electronic visual music conducting device may also be provided with a bar display to indicate numerically which bar is currently being played. The electronic visual music conducting device may also be provided with a beat display to indicate numerically the number of beats per minute associated with the bar currently being played. By utilizing the MIDI Timing Clock signals, twenty four clock pulses are provided for each beat, thereby providing greater resolution and information than normally available in a standard one click per beat click track, and enabling the visual display to show changes in tempo and rhythm which occur between beats.

35 Claims, 11 Drawing Sheets

```
1  /*                Visual Music Conducting Device
2  /*
3  /* Copyright (c) 1991 Phillip M. Vogel, All Rights Reserved
4  /*
5 */
6
7  /* Hardware defines */
8
9  #define     DPORT     0x88 /* ampro DART channel 2 data port */
10 #define     CPORT     0x8c /* ampro DART channel 2 control port */
11 #define     LEDPORT   0x01 /* ampro printer data port */
12
13 /* MIDI control message defines */
14
15 #define     START     0xfa
16 #define     CLICK          0xf8
17 #define     STOP      0xfc
18 #define     CONTINUE  0xfb
19 #define     SPP       0xf2
20 #define     CNTL      0xb0 /* control change channel 1 */
21 #define     CNTLID    0x4f /* Controller 79 */
22
23 int clicks, b, first, last, count, nfirst, nlast, ncount;
24 extern unsigned char *pattern;
25
26 #asm
27   cseg
28 pattern_:
29   db   00
30   ;4/4
31   db   17,16,16,15,15,14,14,14,14,13,13,13
32   db   11,11,50,50,27,27,25,25,51,52,21,22
33
34   db   23,22,22,21,21,20,20,20,20,19,19,19
35   db   24,24,25,26,27,28,29,07,30,32,34,36
36
37   db   38,43,42,41,41,39,39,44,44,44,45,45
38   db   45,46,46,46,47,47,48,48,49,05,06,07
39
40   db   08,07,05,05,04,04,03,03,03,02,02,02
41   db   01,01,02,03,04,05,06,07,09,12,14,16
42
43   ;3/4
44   db   17,16,15,15,13,13,11,11,11,50,50,50
45   db   28,28,07,07,31,31,33,33,35,35,36,37
46
47   db   38,43,42,41,41,39,39,44,44,44,45,45
48   db   45,46,46,46,47,47,48,48,49,05,06,07
49
50   db   08,07,05,05,04,04,03,03,03,02,02,02
51   db   01,01,02,03,04,05,06,07,09,12,14,16
52
53   ;2/4
54   db   17,16,15,15,14,14,13,13,11,11,07,07
55   db   05,05,03,03,01,01,01,03,03,05,06,07
56
57   db   08,07,05,05,04,04,03,03,03,02,02,02
58   db   01,01,03,03,05,05,06,09,11,13,15,16
59
60   cseg
61 #endasm
```

FIGURE 3A

```
62 main()
63 {
64   init();
65   waitstart();
66   first = nfirst, last = nlast, count = ncount;
67   clicks = nfirst - 1;
68
69   while (1) {
70        while ((b=getbyte()) != CLICK && b != STOP && b!= CNTL)
71             ;
72        if (b == STOP) {
73             out (LEDPORT,63);
74             restart();
75        }
76
77        if (b == CNTL) {
78             chkcntl();
79             continue;
80        }
81
82        ++clicks;
83        out (LEDPORT,pattern[ clicks] -1 );
84        if(clicks = last)    /* at end of bar */
85             clicks = nfirst; /* point to start of next bar */
86   }
87 }
88
89 getbyte()
90 {
91   while ((in(CPORT) &1) == 0)
92        ;
93   return (in(DPORT));
94 }
95
96 init()
97 {
98   out (LEDPORT,63);
99   nfirst = 1; /* default to 4/4 for now */
100  nlast = 96;
101  ncount = 96;
102 }
103
104 restart() /* this is for CP/M version */
105 {
106 #asm
107  jmp  100h
108 #endasm
109 }
110
111 waitstart()
112 {
113  while ((b=getbyte()) != START && b != CONTINUE && b != CNTL)
114       ;
115  if(b != CNTL)
116       return(1);
117  chkcntl();
118 }
```

FIGURE 3B

```
119 chkcntl()  /* evaluate control change */
120 {
121  if(getbyte() != CNTLID)
122       return(0);
123  b = getbyte();
124  if (b == 4){    /* 4/4 time */
125       nfirst = 1;
126       nlast = 96;
127       ncount = 96;
128       return(0);
129  }
130  if (b == 3){    /* 3/4 time */
131       nfirst = 97;
132       nlast = 168;
133       ncount = 72;
134       return(0);
135  }
136  if (b == 2){    /* 2/4 time */
137       nfirst = 169;
138       nlast = 216;
139       ncount = 48;
140       return(0);
141  }
142 }
```

FIGURE 3C

Visual Music Conducting Device

LED Number/Clock Number schedules for various time signatures:

Time Sig: 4/4

Beat 1

| | | | | | | | | | | | | | | | | | | | | | | | |
|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 17 | 16 | 16 | 15 | 15 | 14 | 14 | 14 | 14 | 13 | 13 | 13 | 11 | 11 | 50 | 50 | 27 | 27 | 25 | 25 | 51 | 52 | 21 | 22 |

Beat 2

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 23 | 22 | 22 | 21 | 21 | 20 | 20 | 20 | 20 | 19 | 19 | 19 | 24 | 24 | 25 | 26 | 27 | 28 | 29 | 07 | 30 | 32 | 34 | 36 |

Beat 3

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 38 | 43 | 42 | 41 | 41 | 39 | 39 | 44 | 44 | 44 | 45 | 45 | 45 | 46 | 46 | 46 | 47 | 47 | 48 | 48 | 49 | 05 | 06 | 07 |

Beat 4

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 08 | 07 | 05 | 05 | 04 | 04 | 03 | 03 | 03 | 02 | 02 | 02 | 01 | 01 | 02 | 03 | 04 | 05 | 06 | 07 | 09 | 12 | 14 | 16 |

---

Time Sig: 3/4

Beat 1

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 17 | 16 | 15 | 15 | 13 | 13 | 11 | 11 | 11 | 50 | 50 | 50 | 28 | 28 | 07 | 07 | 31 | 31 | 33 | 33 | 35 | 35 | 36 | 37 |

Beat 2

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 38 | 43 | 42 | 41 | 41 | 39 | 39 | 44 | 44 | 44 | 45 | 45 | 45 | 46 | 46 | 46 | 47 | 47 | 48 | 48 | 49 | 05 | 06 | 07 |

Beat 3

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 08 | 07 | 05 | 05 | 04 | 04 | 03 | 03 | 03 | 02 | 02 | 02 | 01 | 01 | 02 | 03 | 04 | 05 | 06 | 07 | 09 | 12 | 14 | 16 |

---

Time Sig: 3/4 (in one)

Beat 1

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 17 | 16 | 15 | 14 | 14 | 13 | 13 | 12 | 12 | 11 | 11 | 10 | 10 | 10 | 09 | 09 | 09 | 07 | 07 | 07 | 07 | 06 | 06 | 06 |

Beat 2

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 06 | 05 | 05 | 05 | 05 | 05 | 04 | 04 | 04 | 04 | 04 | 03 | 03 | 03 | 03 | 03 | 03 | 02 | 02 | 02 | 02 | 02 | 02 | 01 |

Beat 3

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 01 | 01 | 01 | 01 | 03 | 03 | 03 | 05 | 05 | 05 | 07 | 07 | 07 | 09 | 09 | 10 | 10 | 11 | 11 | 12 | 13 | 14 | 15 | 16 |

---

Time Sig: 2/4

Beat 1

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 17 | 16 | 15 | 15 | 14 | 14 | 13 | 13 | 11 | 11 | 07 | 07 | 05 | 07 | 03 | 03 | 01 | 03 | 03 | 03 | 03 | 05 | 06 | 07 |

Beat 2

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 08 | 07 | 05 | 05 | 04 | 04 | 03 | 03 | 03 | 02 | 02 | 02 | 01 | 01 | 03 | 03 | 05 | 05 | 06 | 09 | 11 | 13 | 15 | 16 |

FIGURE 5A

Time Sig: 6/4

Beat 1

| | | | | | | | | | | | | | | | | | | | | | | | |
|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 17 | 16 | 16 | 15 | 15 | 14 | 14 | 14 | 14 | 13 | 13 | 13 | 11 | 11 | 50 | 50 | 27 | 27 | 25 | 25 | 51 | 52 | 21 | 22 |

Beat 2

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 23 | 22 | 22 | 21 | 21 | 20 | 20 | 20 | 20 | 19 | 19 | 19 | 18 | 18 | 18 | 19 | 19 | 19 | 19 | 20 | 20 | 21 | 21 | 22 |

Beat 3

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 23 | 22 | 22 | 21 | 21 | 20 | 20 | 20 | 20 | 19 | 19 | 19 | 24 | 24 | 25 | 26 | 27 | 28 | 29 | 07 | 30 | 32 | 34 | 36 |

Beat 4

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 38 | 43 | 43 | 42 | 42 | 42 | 41 | 41 | 41 | 41 | 40 | 40 | 39 | 39 | 40 | 40 | 40 | 40 | 41 | 41 | 41 | 42 | 42 | 43 |

Beat 5

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 38 | 43 | 42 | 41 | 41 | 39 | 39 | 44 | 44 | 44 | 45 | 45 | 45 | 46 | 46 | 46 | 47 | 47 | 48 | 48 | 49 | 05 | 06 | 07 |

Beat 6

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 08 | 07 | 05 | 05 | 04 | 04 | 03 | 03 | 03 | 02 | 02 | 02 | 01 | 01 | 02 | 03 | 04 | 05 | 06 | 07 | 09 | 12 | 14 | 16 |

---

Time Sig: 5/4

Beat 1

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 17 | 16 | 16 | 15 | 15 | 14 | 14 | 14 | 14 | 13 | 13 | 13 | 11 | 11 | 50 | 50 | 27 | 27 | 25 | 25 | 51 | 52 | 21 | 22 |

Beat 2

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 23 | 22 | 22 | 21 | 21 | 20 | 20 | 20 | 20 | 19 | 19 | 19 | 24 | 24 | 25 | 26 | 27 | 28 | 29 | 07 | 30 | 32 | 34 | 36 |

Beat 3

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 38 | 43 | 42 | 41 | 41 | 39 | 39 | 44 | 44 | 44 | 45 | 45 | 45 | 46 | 46 | 46 | 47 | 47 | 48 | 48 | 49 | 05 | 06 | 07 |

Beat 4

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 08 | 07 | 06 | 06 | 06 | 05 | 05 | 05 | 03 | 03 | 08 | 01 | 01 | 01 | 03 | 03 | 03 | 03 | 04 | 04 | 04 | 05 | 06 | 07 |

Beat 5

| | | | | | | | | | | | | | | | | | | | | | | | | |
|---|---|---|---|---|---|---|---|---|---|---|---|---|---|---|---|---|---|---|---|---|---|---|---|---|
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 08 | 07 | 05 | 05 | 04 | 04 | 03 | 03 | 03 | 02 | 02 | 02 | 01 | 01 | 02 | 03 | 04 | 05 | 06 | 07 | 09 | 12 | 14 | 16 |

---

Time Sig: 6/8 (in six)

Beat 1

| | | | | | | | | | | | | | | | | | | | | | | | | |
|---|---|---|---|---|---|---|---|---|---|---|---|---|---|---|---|---|---|---|---|---|---|---|---|---|
| | | | | | | | | | | | | 2 | | | | | | | | | | | | |
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 17 | 16 | 14 | 14 | 14 | 11 | 50 | 27 | 24 | 52 | 21 | 22 | 23 | 22 | 21 | 21 | 20 | 20 | 18 | 18 | 20 | 20 | 21 | 22 |

Beat 3

| | | | | | | | | | | | | | | | | | | | | | | | | |
|---|---|---|---|---|---|---|---|---|---|---|---|---|---|---|---|---|---|---|---|---|---|---|---|---|
| | | | | | | | | | | | | 4 | | | | | | | | | | | | |
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 23 | 22 | 21 | 24 | 24 | 51 | 26 | 26 | 30 | 33 | 35 | 37 | 38 | 43 | 42 | 42 | 41 | 41 | 39 | 39 | 41 | 41 | 42 | 43 |

Beat 5

| | | | | | | | | | | | | | | | | | | | | | | | | |
|---|---|---|---|---|---|---|---|---|---|---|---|---|---|---|---|---|---|---|---|---|---|---|---|---|
| | | | | | | | | | | | | 6 | | | | | | | | | | | | |
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 38 | 43 | 42 | 42 | 40 | 40 | 44 | 46 | 48 | 04 | 06 | 07 | 08 | 07 | 06 | 04 | 01 | 02 | 05 | 09 | 12 | 14 | 15 | 16 |

FIGURE 5B

Time Sig: 6/8 (in two)

| | | | | | | | | | | | | | | | | | | | | | | | |
|---|---|---|---|---|---|---|---|---|---|---|---|---|---|---|---|---|---|---|---|---|---|---|---|
| Beat 1 (1) | | | | | | | | | | | | 2 | | | | | | | | | | | |
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 17 | 16 | 15 | 15 | 14 | 14 | 14 | 13 | 13 | 13 | 11 | 11 | 11 | 07 | 07 | 07 | 07 | 07 | 05 | 05 | 05 | 03 | 03 | 03 |
| Beat 3 | | | | | | | | | | | | | 4 (2) | | | | | | | | | | | |
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 01 | 01 | 01 | 01 | 03 | 03 | 03 | 03 | 05 | 05 | 06 | 07 | 08 | 07 | 06 | 05 | 04 | 04 | 04 | 03 | 03 | 03 | 02 | 02 |
| Beat 5 | | | | | | | | | | | | | 6 | | | | | | | | | | | |
| Clk | 01 | 02 | 03 | 04 | 05 | 06 | 07 | 08 | 09 | 10 | 11 | 12 | 13 | 14 | 15 | 16 | 17 | 18 | 19 | 20 | 21 | 22 | 23 | 24 |
| Lt | 02 | 01 | 01 | 03 | 03 | 03 | 05 | 05 | 05 | 06 | 06 | 06 | 09 | 09 | 09 | 09 | 11 | 11 | 11 | 11 | 13 | 13 | 15 | 16 |

FIGURE 5C

Visual Music Conducting Device

Meta Patterns

PATTERN A (Primary Beat and Reflex)
17, 16, 15, 14, 13

PATTERN B (Approach to Weak Beat -> Left)
18, 19, 20, 21, 22

PATTERN C (Weak Beat -> Left, and Reflex)
23, 22, 21, 20, 19

PATTERN D (Approach to Secondary Beat)
24, 25, 26, 27, 28, 29, 7, 30, 31, 32, 33, 34, 35, 36, 37

PATTERN E (Secondary Beat and Reflex)
38, 43, 42, 41, 40

PATTERN F (Approach to Top Beat)
3, 4, 5, 6, 7

PATTERN G (Last Beat and Reflex)
8, 7, 6, 5, 4, 3, 2, 1

PATTERN H (Approach to Primary Beat)
1, 2, 3, 4, 5, 6, 7, 9, 10, 11, 12, 13, 14, 15, 16

PATTERN I (Weak Beat -> Top (but not last beat) and Reflex)
8, 7, 6, 5, 4

PATTERN J (Approach to Weak Beat -> Bottom)
12, 13, 14, 15, 16

PATTERN K (Approach to Weak Beat -> Right)
39, 40, 41, 42, 43

FIGURE 6

Visual Music Conducting Device

Pattern Sequences for Each Time Signature Using Meta Patterns

| BEATS IN BAR | BEAT No. | SEQUENCE |
|---|---|---|
| 1 | 1 | A, H |
| 2 | 1 | A, F |
| | 2 | G, H |
| 3 | 1 | A, D |
| | 2 | I, F |
| | 3 | G, H |
| 4 | 1 | A, B |
| | 2 | C, D |
| | 3 | E, F |
| | 4 | G, H |
| 5 | 1 | A, B |
| | 2 | C, D |
| | 3 | E, K |
| | 4 | E, F |
| | 5 | G, H |
| 6 | 1 | A, B |
| | 2 | C, B |
| | 3 | C, D |
| | 4 | E, K |
| | 5 | E, F |
| | 6 | G, H |
| 7 | 1 | A, B |
| | 2 | C, B |
| | 3 | C, K |
| | 4 | E, K |
| | 5 | E, F |
| | 6 | I, F |
| | 7 | G, H |
| 8 | 1 | A, J |
| | 2 | A, B |
| | 3 | C, B |
| | 4 | C, D |
| | 5 | E, K |
| | 6 | E, F |
| | 7 | I, F |
| | 8 | G, H |
| 9 | 1 | A, J |
| | 2 | A, J |
| | 3 | A, D |
| | 4 | E, K |
| | 5 | E, K |
| | 6 | E, F |
| | 7 | I, F |
| | 8 | I, F |
| | 9 | G, H |
| 10 | 1 | A, J |
| | 2 | A, B |
| | 3 | C, B |
| | 4 | C, K |
| | 5 | E, K |
| | 6 | E, B |
| | 7 | C, B |
| | 8 | C, F |
| | 9 | I, F |
| | 10 | G, H |
| 12 | 1 | A, J |
| | 2 | A, J |
| | 3 | A, B |
| | 4 | C, B |
| | 5 | C, B |
| | 6 | C, D |
| | 7 | E, K |
| | 8 | E, K |
| | 9 | E, F |
| | 10 | I, F |
| | 11 | I, F |
| | 12 | G, H |

For 11, 13, 14 and More:

| BEAT No. | | SEQUENCE |
|---|---|---|
| 1 | | A, B |
| 2 | | C, D |
| 3 | | E, F |
| 4 | > | |
| THRU | >>>> | I, F |
| PENULTIMATE*> | | |
| LAST | | G, H |

(*) Repeat second-last bar *n* times. *n* = beats in bar minus 4.

FIGURE 7

VISUAL MUSIC CONDUCTING DEVICE

BACKGROUND OF THE INVENTION

This invention relates, generally, to the field of musical instrument electronics, and more particularly to an electronic visual music conducting device which provides a visual simulation of the movement a conductor's baton.

In the field of music and musical instruments, a revolution has taken place in recent years as microprocessors and computers have become fully integrated into all stages of composition, scoring, performance and instrument design. While this merger of computers, electronics and musical instruments continues today in a well defined environment, early efforts were considerably more experimental, lacking in standardization.

Prior to the development of the now well known Musical Instrument Digital Interface (MIDI) standard, computers of all types, from microcomputers to large mainframe computers, were used by students of electronics and music in many different ways. Some of the earliest efforts to combine computers and music resulted in the development of new electronic instruments, later known as synthesizers, which were designed to create any sound, natural or man-made, which could be imagined. Other efforts focused on the use of computers to compose music, incorporating basic theories of artificial intelligence and conventional music theory to create new music and musical forms. Still other pioneers set out to use computers to reduce the tedium associated with traditional transcription and scoring by having the results of music played on a piano-like keyboard printed directly as sheet music.

Unfortunately, while this early innovation continued apace, the lack of any electronic musical instrument standards kept communications between different instruments, or between instruments and stand-alone computers, to a minimum. Each manufacturer developed a different architecture and interface for their electronic musical product, with the result that instruments from different manufacturers often couldn't communicate with each other. In addition, the manner in which each of these early electronic musical instruments interfaced directly with computers was quite different, making it almost impossible for the data stored on a computer from one instrument to be transmitted or used, and still make any sense, to another instrument.

Therefore, as electronics became less expensive and more powerful, manufacturers who had begun to develop instruments which had true studio and performance value, as well as others involved in the music industry, came to an understanding that a unified system for establishing communications and information interchange between electronic musical instruments, and other studio equipment, was needed. The result of this need was the adoption and promulgation of the Musical Instrument Digital Interface (MIDI) standard by the International MIDI Association. This standard, published in 1983, defines a hardware and data format to enable synthesizers, sequencers, home computers, drum machines, etc., to be interconnected through a standard serial interface.

As a result of the wide spread acceptance of the MIDI standard, musical instruments (keyboard, wind and percussion) as well as accessories (sequencers, editors and librarians) of all types have been developed which are capable of connecting to a MIDI network and sharing data. These new MIDI instruments and devices have enabled composers and performers to work more efficiently and creatively in traditional ways, and have also provided a fertile ground for the development of new techniques for the composition, production and performance of music. Of particular importance has been the greatly expanded use of multi-track digital sequencers.

Generally speaking, a sequencer is a multi-track digital event recorder/player. It may be a stand alone unit, or it may be a specialized software program designed to run on a general purpose computer. In practice a musician uses a sequencer to lay down a series of "virtual tracks", one track at a time. Each track contains a single part, and by using the sequencer a single musician or composer can build and refine musical structures in a manner similar to the way that an author uses a word processor to write lengthy multi-part documents. In addition, after recording, the user can then use the sequencer to play back multiple parts, simultaneously, in real time. This real time simultaneous playback capability is especially important in the studio and performance environment, where the sequenced instruments may be used to accompany live musicians.

When live musicians play along with pre-recorded or sequenced music, it is common for each musician to employ the use of a headphone to listen to a "click track". This is simply a metronomic click, derived from the MIDI data generated by the sequencer, which typically occurs at the rate of one click per musical beat. While such an arrangement is acceptable when the music to be performed has a steady tempo, many problems occur when the beat is more "free style", and not at regularly spaced intervals. Musical ritardando's and accelerando's are used to speed up or slow down the tempo of music during performance, while rubato's, fermata's and the like lengthen or shorten the duration of individual musical notes. These temporal deviations are critical to the expressive element involved in the performance of music, and yet are often missed when performers follow a simple click track, since changes in rhythm may often take place between beats, and thus, between clicks. In addition, watching performers who are listening to click tracks through headphones spoils the visual appeal of seeing musicians perform live. The alternative, unfortunately, is no more attractive since the use of click tracks without headphones, especially during a live performance before an audience, is completely unacceptable since the click track can often be heard by the audience.

In an effort to overcome the above noted problems, the use of a human conductor has been employed, with the conductor being the only person to listen to click tracks through a headphone, while conducting musicians and performers in a more traditional way. Following a conductor is much easier for musicians and singers since the conductor's baton does not disappear between beats. In addition, through the movement of the conductor's baton, the timing of each beat may be anticipated by visually observing the baton's acceleration and deceleration. Finally, a conductor's baton may also be used to indicate not only tempo, but musical dynamics, by varying the distance of movement from one beat to the next.

Unfortunately, the conductor's headphone click track is also typically limited to the above noted one click per beat, with the result being that while musicians are able to follow the fluid movements of a human conductor, the conductor is limited to following discrete clicks, and thereby encounters all of the aforenoted limitations of click tracks.

Accordingly, it has been determined that the need exists for an improved electronic visual music conducting device which permits live musicians to follow complex musical tempo changes by visually observing a display which, under the control of a MIDI data stream, may simulate the complete range of movements of a conductor's baton.

SUMMARY OF THE INVENTION

Generally speaking, in accordance with the invention, an electronic visual music conducting device is provided which is adapted to receive electronic timing signals representative of the tempo of a piece of music, and to use these timing signals to control a visual display which indicates tempo and rhythm by simulating the movements of a conductor's baton.

In a preferred configuration, the invention incorporates a microprocessor based controller connected to a Light Emitting Diode (LED) display panel and the MIDI port of a sequencer or other digital musical instrument. The LED display panel is configured so that as the LED's are illuminated, they describe the movement of a conductor's baton for a standard time signature. In operation, the controller examines an incoming MIDI data stream to extract the System Real Time Message containing the Timing Clock (F8H). This Timing Clock message is then used by the controller to turn on and turn off the appropriate LED's of the display panel. Since, under the MIDI standard, the Timing Clock is sent at a rate of 24 clocks per quarter note, the controller may constantly monitor the incoming MIDI data and thereby display changes in tempo or rhythm which occur between beats.

Accordingly, it is an object of the invention to provide an improved visual music conducting device which simulates the movement of a conductor's baton.

It is another object of the invention to provide an improved visual music conducting device which may interface to a Musical Instrument Digital Interface.

It is a further object of the invention to provide an improved visual music conducting device which may replace a standard click track by allowing a musician to visually anticipate the next beat in a rhythm.

It is still another object of the invention to provide an improved visual music conducting device which may be used on stage during a live performance without distraction to the audience.

It is still a further object of the invention to provide an improved visual music conducting device which may be used in a recording studio to assist musicians in adding musical tracks to pre-recorded material.

It is yet another object of the invention to provide an improved visual music conducting device which may be used to assist a live conductor by replacing a standard click track.

It is yet a further object of the invention to provide an improved visual music conducting device which may be used as an educational device for demonstrating baton movements under different meters.

It is even another object of the invention to provide an improved visual music conducting device which may be used synchronize the live performance of music to film or video.

It is even a further object of the invention to provide an improved visual music conducting device which may be used to replicate intricate tempo and rhythm fluctuations in an exact manner.

It is yet an additional object of the invention to provide an improved visual music conducting device which may be used as an improved stand alone metronome.

Still other objects and advantages of the invention will, in part, be obvious and will, in part, be apparent from the specification.

The invention accordingly comprises the features of construction, combinations of elements and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which:

FIG. 3*a*, 3*b* and 3*c* taken together comprise a source code listing of visual music conducting software employed in accordance with a preferred embodiment of the invention;

FIG. 5*a*, 5*b* and 5*c* taken together comprise a chart illustrating the basic display element patterns utilized in accordance with a preferred embodiment of the invention;

FIG. 6 is a chart illustrating an alternate embodiment of defining display element patterns utilized in accordance with a preferred embodiment of the invention; and FIG. 7 is a chart illustrating pattern sequences built in accordance with the basic display element patterns shown in FIG. 6 for each time signature, in accordance with a preferred embodiment of the invention.

DETAILED DESCRIPTION OF THE PREFERRED EMBODIMENTS

Figure 1:
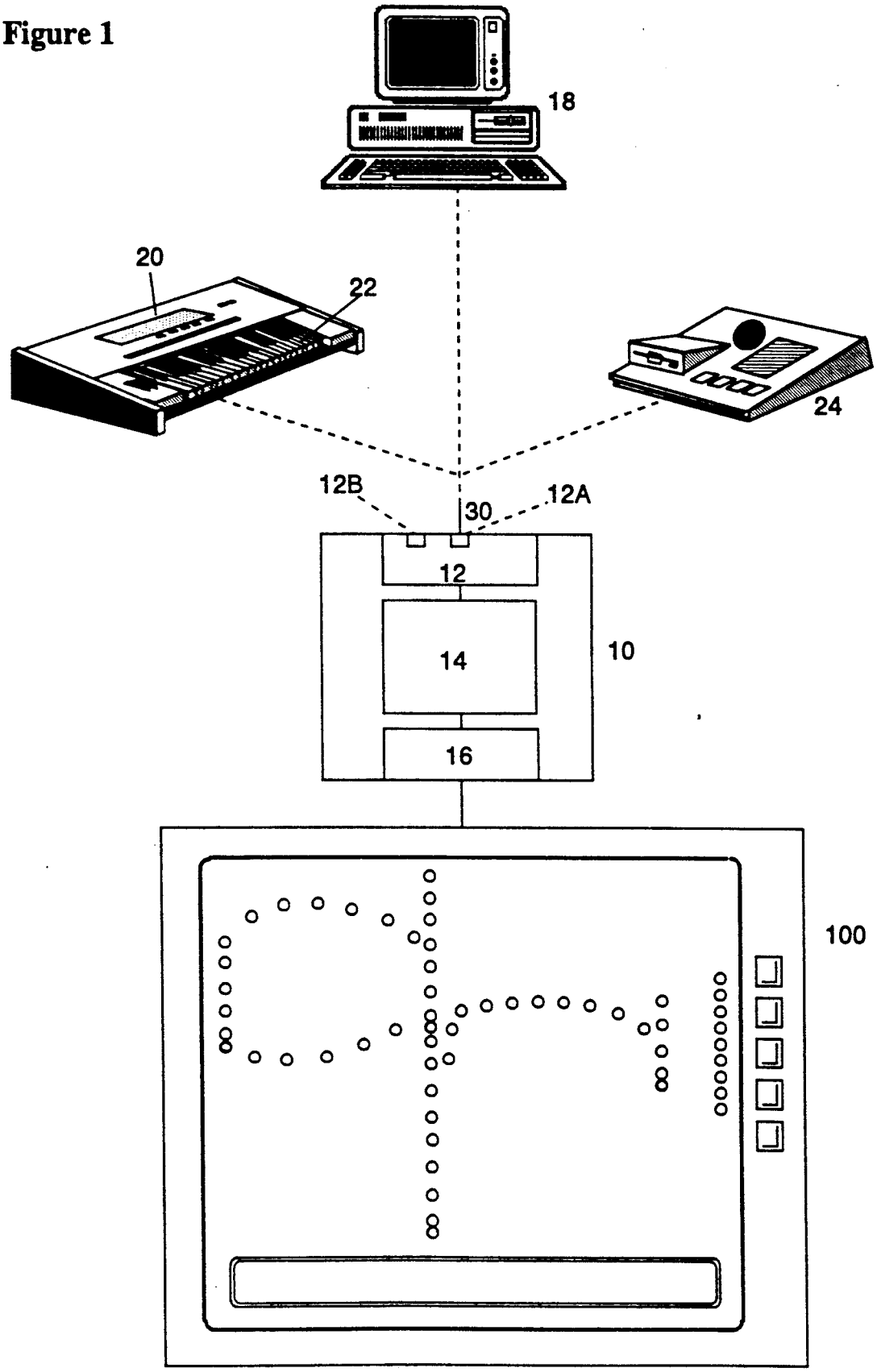
FIG. 1 is a block diagram of a controller constructed in accordance with a preferred embodiment of the invention.

Referring first to FIG. 1, a block diagram of a visual music conducting device, constructed in accordance with a preferred embodiment of the invention, is shown.

The visual music conducting device incorporates a controller, generally referred to as 10, which itself comprises a MIDI interface 12, a processing unit 14 and a display interface 16. The visual musical conducting device also incorporates a display, generally referred to as 100. MIDI interface 12 is of a standard design as defined in the MIDI specification. Display interface 16 is also of a standard design and, in a preferred embodiment of the invention, may be a 6 line to 64 line driving circuit in order to allow 6 data lines from processor 14 to be decoded into driving discreetly up to 64 display elements.

In a preferred configuration, controller 10 is connected through MIDI interface 12 to a MIDI serial data line 30. This connection is made through a MIDI IN connector 12*a*. MIDI interface 12 may also include a MIDI THRU connector 12*b* to allow the visual music conducting device of the instant invention to be "daisy chained" into an existing MIDI system. An outboard PC 18 running a sequencing program, a stand alone sequencer 20, (which may be connected to a MIDI keyboard 22 or other MIDI instrument) or a drum machine 24 are the most common sources of MIDI data to be used with the present invention. However, any system or studio configuration of hardware or software which generates a MIDI data stream may be connected to MIDI IN 12*a*.

In operation, MIDI interface 12, in conjunction with processor 14, examines all of the data on MIDI serial data line 30, and masks out the SYSTEM REAL TIME MESSAGE (F8H), which is defined by MIDI specification 1.0 as the SYSTEM REAL TIME TIMING CLOCK, and which is sent at the MIDI specification defined rate of twenty four clocks per quarter note. This recovered TIMING CLOCK signal is then used by processor 14 to provide appropriately timed control signals to display interface 16 at the higher resolution rate of twenty four counts per beat, a twenty four fold improvement over the more traditional one count per beat click track.

Referring now to FIG. 2 and FIGS. 3*a*, 3*b* and 3*c* (as taken together) a more detailed description of the operation of the system will be described. The software of FIGS. 3*a*, 3*b* and 3*c* is written in the language "C", although any suitable language may be used. In addition, controller 10 is a stand alone microcomputer based controller, such as the AMPRO CP/M LITTLE BOARD®, manufactured by AMPRO COMPUTERS INCORPORATED of Mountain View, Calif. This controller is based on a Zilog Z-80 8 bit microprocessor. While the AMPRO device has been used in the preferred embodiment of the invention, it is appreciated that any suitable stand alone computer based on any suitable microprocessor may be used as long as it has suitable I/O capabilities and operates at a speed fast enough to process a real time MIDI data stream. It is also appreciated that while the present invention incorporates a stand alone controller, controller 10 may be built directly into a MIDI device, such as a sequencer, keyboard, etc.

Figure 2:
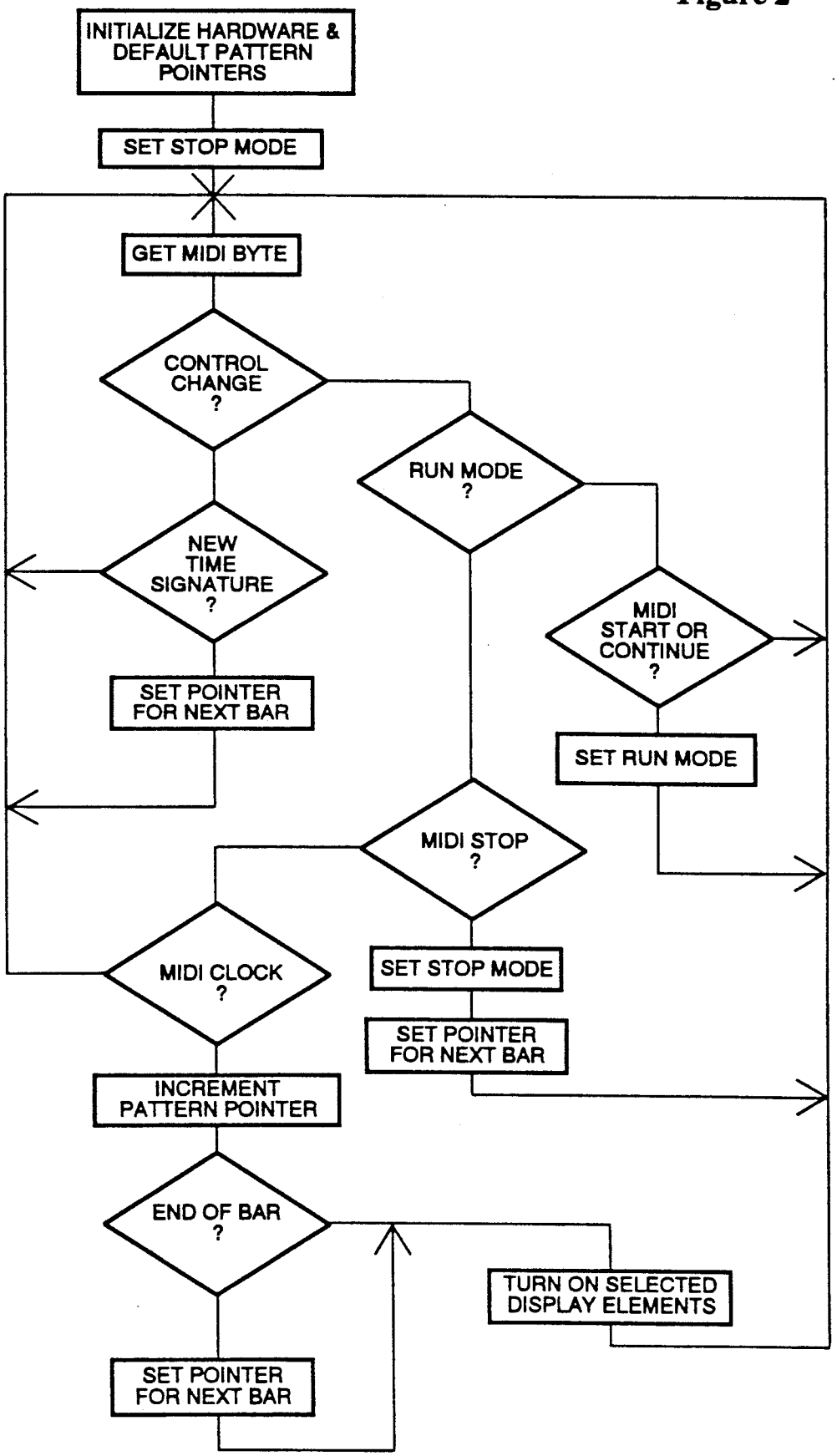
FIG. 2 is flow chart of the processes performed by the software under control of a controller constructed in accordance with a preferred embodiment of the invention.

As illustrated in FIG. 2, upon power up, the visual music conductor of the instant invention executes a series of instructions to initialize the controller hardware and default pattern pointers to a known state. This initialization is accomplished through the definition of variables and tables in lines 1 through 61 of FIG. 3*a*, and is called by the main program at line 62, as seen at the top of FIG. 3*b*, by executing the initialization of line 64 and its related procedure at lines 96 to 101. This initialization routine begins by turning off all of the display elements and setting the timing counters to a default time signature of 4/4 time. (This is done in case the MIDI data stream which is sent to controller 10 does not include a time signature).

Following initialization, the controller puts itself into a standby, or stop mode, and then waits for the arrival of MIDI data. The examination of incoming MIDI data occurs in the body of the main procedure at lines 69 through 85. First, the MIDI data is examined to see if it either a control change message or a run message such as a start, continue or stop message. If it is a control change instruction, the program then filters the data to make sure that control change message received is actually destined for the controller of the visual music conductor. If a control change message is received and it is not for a recognized control change message, then the program loops around to wait for the next MIDI data message. However, if a control change message is received containing a new time signature message, then that new time signature display pattern is selected and is executed at the beginning of the next measure. This selection takes place in lines 119 through 140 of the program as illustrated in FIG. 3*c*. It is recognized that the source code as illustrated provides baton conducting patterns for three possible time signatures: 4/4, $\frac{3}{4}$ and 2/4. These correspond to the display patterns defined between lines 30 and 59. However, it is well understood that additional patterns and time signatures may be added to the program in order to expand the operational parameters of the hardware and software.

Assuming, now, that the MIDI data received is not a control change message, the message is examined to see if it is a run mode message controlling start, stop and continue functions. If the controller is not yet running, and the MIDI data is not a start or continue message, then the program loops around and waits for the next message. However, if the MIDI data is a start or continue message, then a run mode flag is set and the program prepares for the next data event. At this point, when a run mode message is received, the system will begin looking for either a stop mode message or a MIDI system real time clock (F8H) message. If a stop mode message is received, then the stop mode flag is set and the measure pointer is reset to the beginning of a measure, to beat one. If a non-control change message not intended for the controller is received, then the program will once again loop around to wait for the next MIDI event. However, if the system is in its run mode and a MIDI system real time clock (F8H) message is received, then the pattern pointer is incremented. The end of bar counter is then compared to the number of beats per bar based upon the time signature. If the end of the bar has not been reached, then next selected display element as defined by the data pattern table will be selected and activated. However, if the end of a bar has been reached, then the bar position pointer will be reset back to the beginning and the first display element as defined by the data pattern for the most recently selected time signature (as set by the last valid control change message) will be displayed.

By executing such a process, then, the incoming MIDI data stream is constantly examined for changes to time signature, start, stop and continue messages and MIDI system real time clock (F8H) messages. These messages, in turn, act to select data from a predefined data table in order to selectively activate and deactivate display elements in order to present the movement of a conductor's baton.

Figure 4:
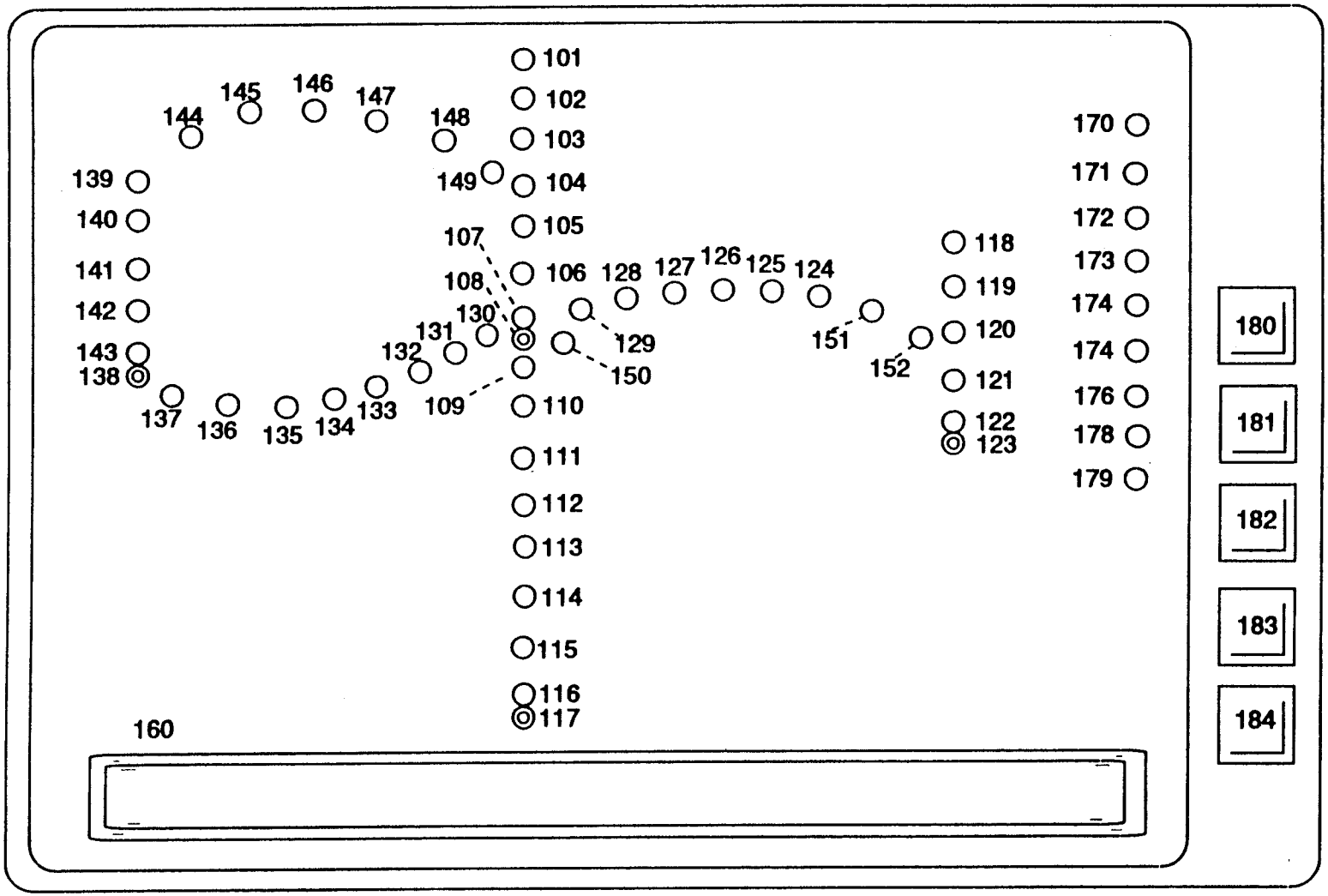
FIG. 4 is a plan view of a display panel constructed in accordance with a preferred embodiment of the invention.

Referring now to FIG. 4, a more detailed description of the activation of display panel 100 will be described. As can be seen, display 100 comprises a plurality of display elements 101-152 which are arranged within the display in a manner which allows them to display baton movements associated with conducting patterns, such as the baton movement associated with $\frac{3}{4}$ time or 4/4 time. Display 100 may also include general purpose alphanumeric display 160, a series of dynamics display elements 170–179, and may further provide the user with a convenient control surface to access controls such as power switch 180, MIDI Channel switch 181, mode switch 182, up button 183 and down button 184.

While display elements 101–152 are preferably Light Emitting Diodes (LED's), they may also be standard incandescent bulbs, neon bulbs, Liquid Crystal Display elements (LCD's) or any other discrete or matrixed display element. Display elements 101–152 may also be simulated through the use of well known software techniques in connection with the use of a raster display, such as a CRT or gas plasma display, or by means of a vector display. While the illuminated color of the display elements is not critical, in practice it is preferable to be able to distinguish those display elements which are "lit" precisely on the beat from those display elements which are lit during the transition from one beat to the next. This may be done using different color display elements or by modulating the intensity of the display elements. In this way, the "beat" of a musical passage will be clearly observable to the musicians viewing display 100.

Using a 4/4 time signature for explanatory purposes, and with reference to FIGS. 3*a*, 3*b* and 3*c* and FIG. 4, a sample musical measure will now be described. Since the SYSTEM REAL TIME TIMING CLOCK is generated at the rate of twenty four clocks per quarter note, processor 14 will read twenty four (F8H) events between the start of the measure and the first beat. Referring to lines 30 through 41 of FIG. 3*a*, it can be seen that for the first beat of a 4/4 time signature, these twenty four clocks will illuminate, sequentially, LED: 117, 116, 116, 115, 115, 114, 114, 114, 114. 113, 113, 113, 111, 111. 150, 150, 127, 127, 125, 125, 151, 152, 121 and 122. For the second beat the illumination pattern will be 123, 122, 122, 121, 121, 120, 120, 120, 120, 119, 119, 119, 124, 124, 125, 126, 127, 128, 129, 107, 130, 132, 134 and 136. The third and fourth beats follow similarly. In this way, the illumination of the display elements will describe a visual movement which is analogous to the visual movement which observed by watching the end of a conductor's baton.

It is noted that by illuminating individual display elements for longer than one clock period (for example, by illuminating LED 114 for four consecutive clock periods), the observed movement between beats will not be linear, but will rather take place with the natural acceleration and deceleration which can be observed in the movements of a human conductor. According to the preferred embodiment, the movement of the visual baton will decelerate immediately after moving away from the previous beat, and thereafter accelerate approaching the next beat, thereby giving the movement of the visual baton a "snap" normally associated with experienced conductors. In addition, because the time between each beat is divided into twenty four separate events, any change in tempo or rhythm between beats will be reflected appropriately in the observed movement of the display. (Because of the programmable nature of the visual acceleration and deceleration of the display in response to the incoming MIDI TIMING CLOCK signal, it will be understood that the appearance of movement in the display may be modified to display different conducting styles which may be more or less linearly related to the tempo of the music.) In addition, by defining additional time signatures (such as $\frac{3}{4}$ and 2/4 illustrated in FIG. 3*a* at lines 43 through 58) any number of different time signatures may be selected and displayed. A series of pre-defined time signatures are described in FIGS. 5*a*, 5*b* and 5*c*, wherein the patterns for 4/4, $\frac{3}{4}$, $\frac{3}{4}$ (in one), 2/4 6/4, 5/4, 6/8 (in 6) and 6/8 (in two) are disclosed. In practice, any one or all of the time signature patterns shown in FIGS. 5*a*, 5*b*, 5*c* may be included in the source code illustrated in FIGS. 3*a*, 3*b* and 3*c*.

As just noted, the appearance of movement may be modified to display different time signatures by predefining such time signatures as part of a data table. However, in a further refinement to the instant invention, additional flexibility may be provided to the user in order to enable new time signatures and baton movement patterns to be defined by using the combination of a series of "meta" movements. As part of the invention, eleven sequences of light patterns have been defined which, combined in different ways, form the building blocks of all standard baton patterns. As shown in FIG. 6, Patterns A through K each define, respectively: (A) Primary beat and reflex; (B) Approach to weak beat - left; (C) Weak beat - left, and reflex; (D) Approach to secondary beat; (E) Secondary beat and reflex; (F) Approach to top beat; (G) Last beat and reflex; (H) Approach to primary beat; (I) Weak beat - top [but not last beat] and reflex; (J) Approach to weak beat bottom; and (K) Approach to weak beat right. Reviewing FIG. 7, the pattern sequences for each time signature using the meta patterns defined in FIG. 6 is shown. In this way, the basic display 100 using display elements 101–152 may be used to display the baton movement patterns of any time signature.

Finally, since certain meters are not always conducted in the same way (for example, a $\frac{3}{4}$ time in a fast tempo is often conducted in 1/1; a 4/4 time in a fast tempo is often conducted in a "cut" time such as 2/2), additional modifications to the display may also be made by utilizing mode button 182 in conjunction with up button 183 and down button 184. In a defined NORMAL MODE, every beat will be conducted, regardless of the time signature. In a defined DOWNBEAT MODE, only the first beat of every bar will be conducted. In VERTICAL MODE, the first beat will be conducted normally. However, subsequent beats within a measure will be conducted using shortened strokes, utilizing those display elements in line with, and directly above those display elements used for the down beat. In VERTICAL MODE the baton does not move from side to side, but only up and down. A CUT MODE may also be available if a measure has an even number of beats. In such a CUT MODE, the time value of the beat is doubled and the number of beats is then divided by two. In this way, a 4/4 measure becomes a 2/2 measure; a 6/4 measure becomes a 3/2 measure; etc. In CUT MODE, if a measure has an odd number of beats, it is conducted in NORMAL MODE. Finally, a TRIPLET MODE may be selected when a measure has at least six beats and the total beats are divisible by three (such as 6/8; 9/8; 12/8; etc.). In such a case, only the first of every three beats will be conducted (6/8 as 2/4; 9/8 as $\frac{3}{4}$; etc.) In TRIPLET MODE, when a measure contains a number of beats which are not evenly divisible by three, they will be conducted in NORMAL MODE.

As noted above, since controller 10 incorporates some form of programmable microprocessor 14, a number of additional features may be added to the invention.

As shown in FIG. 4, additional general purpose alphanumeric display panel 160 may be incorporated within display 100 to display exactly what measure is being displayed by the visual music conducting device. By using well known techniques, controller 10 may keep track of the start of a musical passage and thereafter increase the count displayed bar indicator 160 by one for each measure played. The advantage of such a bar counter is realized in many situations where musicians must sit out a large number of measures before they are required to play. Traditionally, in order to keep track of where in the music they were, musicians have to silently count measures, in accordance with changing tempo's and rhythms. This counting may be especially difficult for percussion players who often have large numbers of measures where they are at rest. By displaying the measure number on bar display 160, a musician may perform other required tasks, while keeping track of the progress of a piece of music.

Alphanumeric display 160 may also be used to display the numeric beat (or beats per minute) of the instant measure. Like the bar display described above, the display of the numeric beat may be controlled by controller 10 using well known methods. In a preferred embodiment, controller 10 incorporates a highly accurate time base, such as a quartz clock. The frequency of this clock is then compared to the incoming TIMING SIGNAL (F8H) to arrive at a number representing beats per minute. This number may then be displayed on alphanumeric display panel 160.

Finally, alphanumeric display panel 160 may also be used to display other MIDI defined text events, such as a copyright notice, instrument name, lyrics, time signature, etc.

Display 100 may also incorporate additional display elements to display musical dynamics in an alternate manner. As noted above, while the sequence of illumination of display elements 101–152 may be modified under software control to display not only changes in rhythm, but also changes in musical dynamics, a series of additional display elements 170–179 may be added to constantly display a bar graph indicative of, for example, pianissimo or fortissimo expression. This information may be extracted from the MIDI data stream and filtered as a control change message by processor 14 to drive display elements 170–179.

It can be appreciated that many other modifications to the invention may be made to alter its operating characteristics to suit the needs of the user. One such modification may be to alter the display driver software so that only a single LED (or other display element) is activated at any one time, or that more than one display element may be activated at the same time, in order to provide a longer "trail" to follow.

It can also be appreciated that while MIDI interface 12, processor 14 and display interface 16 are shown as separate units, their combined functions may all be performed by a single microprocessor with appropriate control software.

It is further noted that while the time signature of the measure being display will most likely be set based upon an appropriately received MIDI control change message (which would be recorded along with other sequencer information during a sequencer recording session), a user may decide to manually override the selected time signature display pattern (or choose one when one is not sent) by manually providing input to controller 14 from the control panel surface of display panel 100.

It is additionally recognized that although the above description has focused on the display of baton movements synchronous with an incoming MIDI data stream, the device of the instant invention may also be used as a stand alone metronome. In such an embodiment, the incoming MIDI data stream may be replaced by an internally generated clock signal which would be used to selectively activate the display elements in a preferred time signature pattern. The speed of the rhythm would then be adjusted by the user through the use of a control such as up button 183 and down button 184.

Finally, it is understood that while the described embodiment of the invention is such that a single unit may be viewed by a number of musicians simultaneously, it is also possible using wired or wireless local or broad area networks to provide a display unit manufactured in accordance with the invention of any practical size, including a personal unit which may be clipped directly to a music stand.

Thus, by utilizing the above construction, an improved visual music conducting device can be provided which provides increased utility with respect to matters of tempo and rhythm when playing music in association pre-recorded or sequenced music, and which overcomes the limitations associated with the use of a click track.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative, and not in a limiting sense.

It will also be understood that the following claims are intended to cover all of the generic and specific features of the invention, herein described, and all statements of the scope of the invention which, as a matter of language, might be said to fall therebetween.

We claim:

1. A visual music conducting device, comprising:

interface means for receiving a music system timing signal;

display means capable of displaying a visual image approximating the movement of a conductor's baton through all the beats of at least one time signature; and control means for receiving said system timing signal from said interface means and controlling said display means in accordance with said system timing signal, said control means being further responsive to changes in said music system timing signal which may occur between musical beats;

wherein, said control means controls the selective illumination of said display means in synchronization with said incoming timing signal to simulate the movement of a conductor's baton including the acceleration and deceleration of such movement which may occur between musical beats.

2. The visual music conducting device, as claimed in claim 1, wherein said music timing signal is the Musical Instrument Digital Interface (MIDI) System Real Time Timing Clock signal.

3. The visual music conducting device, as claimed in claim 2, wherein said display means comprises a plurality of light emitting diodes (LED's) arranged to permit the display of a multiplicity of baton movements corresponding to the conducting of different time signatures.

4. The visual music conducting device, as claimed in claim 2, wherein said control means comprises a stored program control microprocessor.

5. The visual music conducting device, as claimed in claim 4, wherein said control means further comprises a display pattern generating means, said display pattern generating means incorporating a series of stored program instructions corresponding to the movements which would be made by a conductor's baton for at least one selected time signature.

6. The visual music conducting device, as claimed in claim 5, wherein said display pattern generating means defines a series of "meta" baton movements, and whereby said display pattern generating means further combines said predefined "meta" baton movements in a manner to display at least one selected time signature.

7. The visual music conducting device, as claimed in claim 1, wherein the functionality of said interface means is performed by said control means.

8. The visual music conducting device, as claimed in claim 2, wherein said display means comprises a matrix of display elements.

9. The visual music conducting device, as claimed in claim 8, wherein said display elements are incandescent.

10. The visual music conducting device, as claimed in claim 8, wherein said display elements are formed from liquid crystal display (LCD) elements.

11. The visual music conducting device, as claimed in claim 2, wherein said display means comprises a raster scan device.

12. The visual music conducting device, as claimed in claim 11, wherein said raster scan device is a cathode ray tube.

13. The visual music conducting device, as claimed in claim 11, wherein said raster scan device comprises a gas plasma device.

14. The visual music conducting device, as claimed in claim 2, wherein said display means comprises a vector display device.

15. The visual music conducting device, as claimed in claim 14, wherein said vector display device comprises a cathode ray tube.

16. The visual music conducting device, as claimed in claim 2, further comprising:

measure counting means; and measure display means;

wherein said measure display means displays the result calculated by said measure counting means, said measure counting means being adapted to count the number of measures which have passed since the beginning of a piece of music.

17. The visual music conducting device, as claimed in claim 16, wherein the function of said measure counting means is accomplished by said control means and wherein said measure display means comprises a LED numeric display.

18. The visual music conducting device, as claimed in claim 2, further comprising:

beat counting means; and beat display means;

wherein said beat counting means compares the frequency of said MIDI System Real Time Timing Clock to a known time standard, and wherein said beat display means displays the result calculated by said beat counting means, whereby the number of beats per minute of a MIDI System Real Time Timing Clock is displayed.

19. The visual music conducting device, as claimed in claim 1, wherein said display means further comprises a plurality of display modules, each of said display modules being capable of being physically separated and remotely located from each other.

20. The visual music conductive device, as claimed in claim 19, wherein said display modules comprise a plurality of individually illuminatable display elements.

21. The visual music conducting device, as claimed in claim 1, wherein said display means may represent the passage from one musical beat to another musical beat through a change in displayed color.

22. A device capable of visually simulating the movement of a conductor's baton through all the beats of at least one time signature, said simulation of movement including the acceleration and deceleration of such movement due to changes in rhythm or expression which may occur between musical beats, said device operating in response to a MIDI data signal, said MIDI data signal containing a Timing signal, Said Timing Signal occurring at the present MIDI Standard rate of twenty four clock pulses per musical beat, said device comprising:

interface means for connecting to a MIDI serial data line;

processor means for processing said MIDI serial data to extract said twenty four clock pulses per musical beat from said MIDI serial data; and display means adapted to be selectively illuminated in response to the control of said processor means;

wherein said selective illumination of said display means results in the display of a visual facsimile of the movement of a conductor's baton including the acceleration and deceleration of such movement which may occur between musical beats, said movement being synchronized with the receipt of said MIDI Timing Signal.

23. The device for visually simulating the movement of a conductor's baton, as claimed in claim 22, wherein the selective illumination of said display means is further adapted so that during the transition period from one beat to another, the apparent movement of said display means will decelerate as the baton display moves away from the previous beat position and accelerates as the baton display moves towards the next beat position.

24. The device for visually simulating the movement of a conductor's baton, as claimed in claim 22, wherein said selective illumination defines a normal mode where every beat is conducted, regardless of time signature.

25. The device for visually simulating the movement of a conductor's baton, as claimed in claim 22, wherein said selective illumination defines a down beat mode where only the first beat of every bar will be conducted.

26. The device for visually simulating the movement of a conductor's baton, as claimed in claim 22, wherein said selective illumination defines a vertical mode where the down beat of every bar will be conducted normally but where subsequent beats within a measure will be conducted using shorted strokes, utilizing those display elements in line with, and directly above those display elements used for the down beat, so that the apparent movement of the simulated baton will only up and down and not from side to side.

27. The device for visually simulating the movement of a conductor's baton, as claimed in claim 22, wherein said selective illumination defines a cut mode so that where a measure has an even number of beats the time value of each beat is doubled and the number of beats is divided by two.

28. The device for visually simulating the movement of a conductor's baton, as claimed in claim 22, wherein said selective illumination defines a triplet mode so that when a measure has at least six beats and the total number of beats are divisible by three, only the first of every three beats will be conducted.

29. The device for visually simulating the movement of a conductor's baton, as claimed in claim 22, wherein said selective illumination is accomplished by changing the illuminated color of said display means.

30. The device for visually simulating the movement of a conductor's baton, as claimed in claim 22, wherein said display means further comprises a plurality of display modules, each of said display modules being capable of being physically separated and removely located from each other.

31. A visual metronome, comprising:

clock means for generating an accurate clock signal;

adjustment means for adjusting the frequency of said clock means;

display means for displaying a visual image approximating the movement of a conductor's baton through all the beats of at least one time signature, said display means being configured such that at any instant an observer of said display means can determine which beat of a measure is being displayed; and control means for receiving said clock signal generated by said clock means and thereby controlling said display means in accordance with said clock signal;

wherein a signal metronome may be provided which displays each of the beats of a time signatures in an identifiable manner similar to the movement of a conductor's baton through the same beats under the same time signature by the selective illumination of said display means.

32. The visual metronome, as claimed in claim 31, wherein said display means may represent the passage from one musical beat to another musical beat by changing the illuminated color of said display means.

33. The visual metronome, as claimed in claim 31, wherein said display means further comprises a plurality of display modules, each of said display modules being capable of being physically separated and remotely located from each other.

34. A visual music conducting device, comprising:

interface means for receiving a music system timing signal generated external of said visual music conducting device, said timing signal responsive to and representative of the rhythm and tempo of the musical beats of a music score as well as changes in rhythm and tempo which may occur between musical beats in a music score;

display means for displaying a visual image; and control means for receiving said system timing signal from said interface means and controlling said display means in accordance with said system timing signal;

wherein said control means controls the selective illumination of said display means in synchronization with said incoming timing signal to display the occurrence of musical beats and the passage of time between musical beats which passage of time may be irregular in nature and which passage may embody a change in musical time signature.

35. The visual music conducting device, as claimed in claim 34, wherein said display means may represent the passage from one musical beat to another musical beat by changing the illuminated color of said display means.

* * * * *